US012760733B2

(12) United States Patent
Sun

(10) Patent No.: US 12,760,733 B2
(45) Date of Patent: Oct. 13, 2026

(54) SCREW AIR COMPRESSOR UNIT WITH ENERGY STORAGE

(71) Applicant: TNT MANUFACTURING CO., LTD., Taichung City (TW)

(72) Inventor: Chih Hsing Sun, Taichung City (TW)

(73) Assignee: TNT MANUFACTURING CO., LTD., Taichung City (TW)

( * ) Notice: Subject to any disclaimer, the term of this patent is extended or adjusted under 35 U.S.C. 154(b) by 226 days.

(21) Appl. No.: 18/671,942

(22) Filed: May 22, 2024

(65) Prior Publication Data

US 2025/0361866 A1 Nov. 27, 2025

(51) Int. Cl.

| | |
|---|---|
| ***F04C 29/04*** | (2006.01) |
| ***F04C 18/16*** | (2006.01) |
| ***F04C 23/02*** | (2006.01) |

(52) U.S. Cl.

CPC ..... *F04C 29/047* (2013.01); *F04C 18/16* (2013.01); *F04C 23/02* (2013.01); *F04C 2240/40* (2013.01); *F04C 2240/808* (2013.01)

(58) Field of Classification Search

CPC ..... F04C 29/047; F04C 18/16; F04C 23/02; F04C 2240/40; F04C 2240/808; F04C 29/04; F04C 2240/403; F04C 2240/80

USPC ..... 318/139, 558

See application file for complete search history.

(56) References Cited

U.S. PATENT DOCUMENTS

| | | | | |
|---|---|---|---|---|
| 9,850,896 | B2 * | 12/2017 | Desiron | F04C 2/16 |
| 9,897,663 | B2 * | 2/2018 | Hong | H01M 10/425 |
| 11,271,500 | B2 * | 3/2022 | Wakabayashi | B60L 50/16 |
| 11,879,380 | B2 * | 1/2024 | Kumar | B60W 10/08 |

* cited by examiner

*Primary Examiner* — David Luo
(74) *Attorney, Agent, or Firm* — Che-Yang Chen

(57) ABSTRACT

The invention provides a screw air compressor unit with energy storage, which mainly includes a power battery module, a frequency converter, a permanent magnet synchronous motor, and a screw air compressor respectively arranged therein. The frequency converter is connected to the power battery module and converts the electrical energy thereof into the voltage and frequency required by the permanent magnet synchronous motor. When the permanent magnet synchronous motor obtains electrical energy, and can correspondingly drive the screw air compressor to operate and store air. As mentioned above, by changing the power supply source, the power battery module is used to supply the power of the permanent magnet synchronous motor and the energy storage of the linked air compressor, which effectively achieves the functions and advantages of energy saving, noise reduction and equipment size.

10 Claims, 3 Drawing Sheets

SCREW AIR COMPRESSOR UNIT WITH ENERGY STORAGE

FIELD OF INVENTION

The invention relates to an air compressor equipment with energy storage, energy saving, low power and low noise performance.

DESCRIPTION OF RELATED ARTS

Power machinery and tools suitable for outdoor applications, such as welding machines, generators, hydraulic power units (HPU) and air compressors. These machinery and tools are usually powered by internal combustion engines, such as gasoline engines or diesel engines. However, these systems have drawbacks such as high noise, the need for many filters and lubricants for maintenance, as well as the generation of heat and toxic fumes during operation.

In the case of an air compressor, it generally includes a base plate, a cylinder combined with the base plate, a motor assembled on the base plate, a driving gear pivotally connected to the motor output shaft, a driven gear meshed with the driving gear, and an eccentric connecting rod pivoted to the driven gear and a piston body that reciprocates in the cylinder at the same time. By driving the driven gear through the driving gear, the piston body will reciprocate in the cylinder to generate compressed air. The generated compressed air can push a valve mechanism through the air outlet of the cylinder, allowing the compressed air to enter another space used to store compressed air. The space can be the space within an air storage tank (or air receiver), which is also provided with an outlet for delivering the compressed air to the item to be inflated to complete the entire inflation process.

Another technology such as Chinese Invention Patent No. CN215949827 "Integrated Screw Air Compressor for Locomotive". However, the traditional air compressors use cylinders as the crimping power and cannot be directly connected to electricity. As a result, the current air compressors are limited in use and also produce noise. Therefore, there are also research and development applications in the industry such as US Patent Application No. 20230050997, "Electric Air Compressor System and Power Regulator therefor" to improve the aforementioned deficiencies of air compressor equipment.

The above-mentioned patents can indeed supply power to the air compressor with electricity. However, they will also be slightly inconvenient to use. In order to improve and provide technology different from the above-mentioned structure, the inventor of the present invention has been working hard on research and development in the spirit of excellence, aiming to make life more humanized and technologically advanced, and creating a new life with a diligent attitude.

SUMMARY OF THE PRESENT INVENTION

In order to solve the shortcomings of the prior art mentioned above, the main objective of the present invention is to provide an air compressor technology that can be powered and stored by batteries, and to use a frequency converter to convert the electrical energy of the batteries into the voltage and frequency required by the permanent magnet synchronous motor, in order to overcome the difficulties in the prior art.

The secondary objective of the present invention is to provide an air compressor technology with low power and low noise, which uses batteries to supply power and store energy, which can effectively save energy, reduce noise and reduce the volume of the equipment, so that it is more convenient to use.

In order to achieve the above objectives, the technical solution provided by the present invention is a screw air compressor unit with energy storage, which includes a power battery module, a frequency converter, a permanent magnet synchronous motor and a screw air compressor respectively provided thereon. The frequency converter is connected with the power battery module and converts the electrical energy thereof into the voltage and frequency required by the permanent magnet synchronous motor. When the permanent magnet synchronous motor obtains electrical energy and can correspondingly drive the screw air compressor to operate and store air. As mentioned above, by changing the power supply source, the power battery module is used to supply the power of the permanent magnet synchronous motor and the energy storage of the linked air compressor, which effectively achieves the functions and advantages of energy saving, noise reduction and equipment size.

The power battery module is composed of one or more battery cells or battery packs, mainly responsible for storing and releasing electrical energy, wherein the power battery module is correspondingly connected with the screw air compressor, and provides a power source therefor.

The frequency converter includes a rectifier, a filter, an inverter, a braking unit, a driving unit, a detection unit and a microprocessor unit respectively provided thereon.

The power battery module includes a battery management system (11) [BMS] installed therein, which is capable of obtaining the working status information of the power battery module, wherein the battery management system (11) periodically measures the voltage, current, and temperature of the power battery module.

The screw air compressor unit with energy storage includes a controller provided thereon, wherein a data obtained by the battery management system (11) [BMS] is transmitted to the controller, wherein the controller protects the power battery module through the battery management system (11).

The frequency converter has an insulated gate bipolar transistor [IGBT] arranged therein, wherein the switching of the insulated gate bipolar transistor is capable of adjusting the voltage and frequency of the output power supply of the power battery module, and provide the required power supply voltage according to the needs of the permanent magnet synchronous motor.

The screw air compressor unit with energy storage includes a cooling fan provided thereon, wherein the cooling fan corresponds to the power battery module and is capable of dissipating the heat energy generated by the power battery module.

DETAILED DESCRIPTION OF THE PREFERRED EMBODIMENT

The present invention is described in detail below with reference to the accompanying drawings and in the form of embodiments. The drawings used in this article are only intended to be illustrative and auxiliary to the specification, and may not represent the actual proportions and precise configurations of the present invention after implementation. Therefore, the patent scope of the present invention in actual implementation should not be limited by the proportions and arrangement relationships of the attached drawings.

Figure 1:
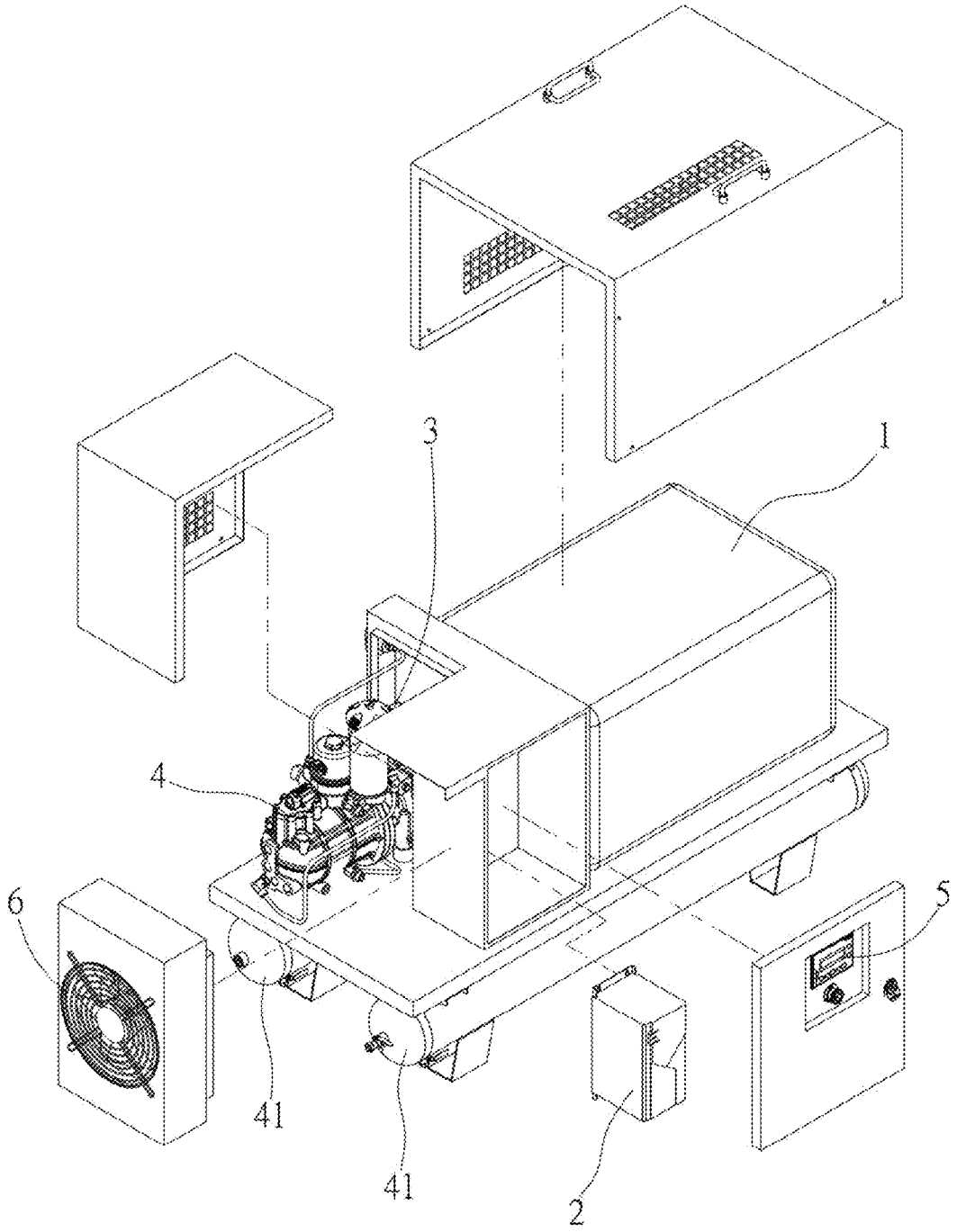
FIG. 1 is an overall exploded view of a screw air compressor unit with energy storage according to the present invention.
Figure 2:
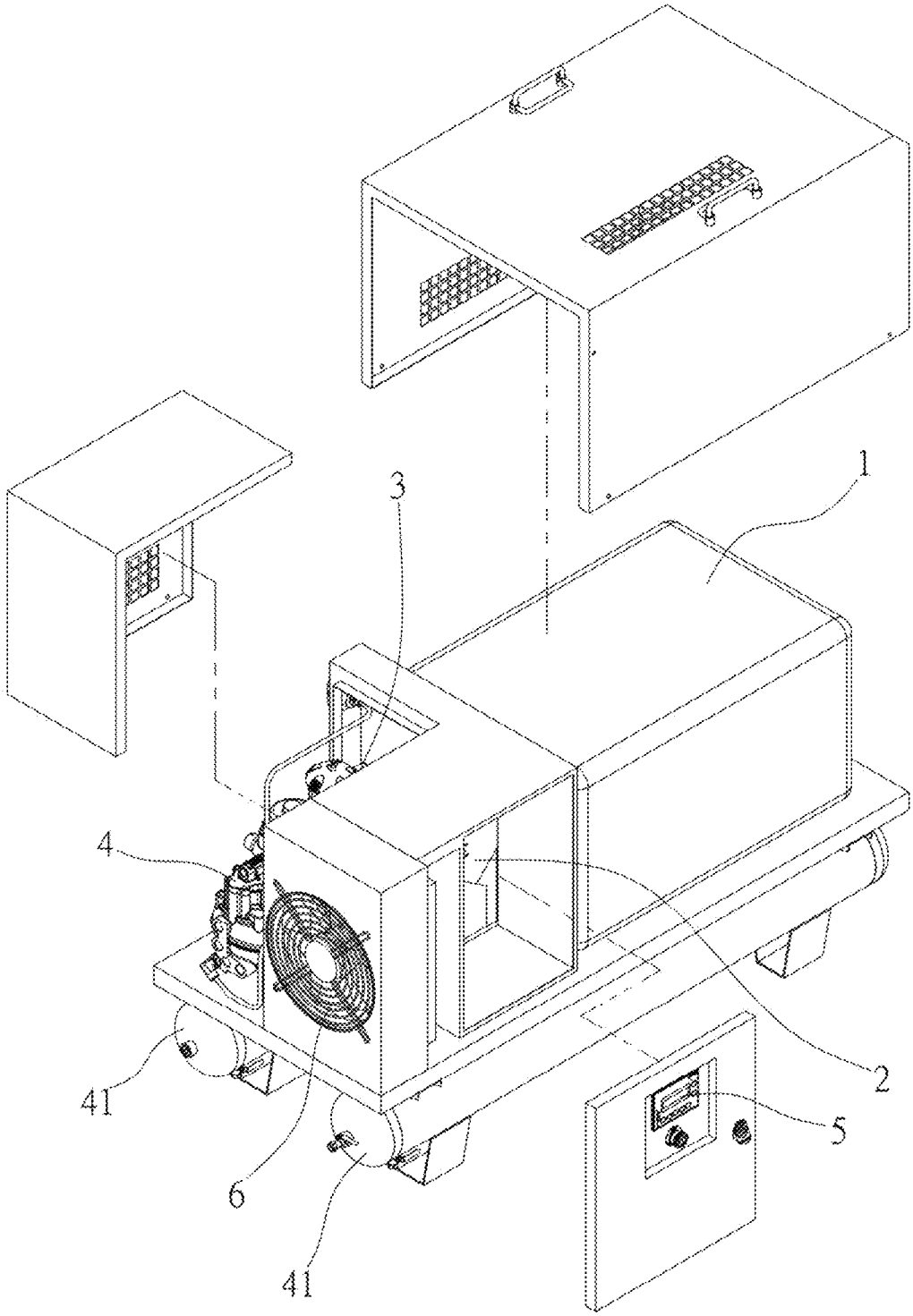
FIG. 2 is an assembled perspective view of the screw air compressor unit with energy storage according to the present invention.

Referring to the overall exploded and assembly view of the screw air compressor unit with energy storage of the present invention in FIGS. 1~2, in which the present invention shows that the present invention includes a power battery module (1), a frequency converter (2), a permanent magnet synchronous motor (3) and a screw air compressor (4) respectively provided thereon, wherein the power battery module (1) is composed of more than one battery cell or battery pack, which is mainly responsible for storing and releasing electrical energy, wherein the power battery module (1) is correspondingly connected with the screw air compressor (4), and provides a power source therefor.

The frequency converter (2) is connected with the power battery module (1) and converts the electrical energy released by the power battery module (1) into the voltage and frequency required by the permanent magnet synchronous motor (3). Further, the frequency converter (2) includes a rectifier, a filter, an inverter, a braking unit, a driving unit, a detection unit and a microprocessor unit respectively provided thereon.

The permanent magnet synchronous motor (3) is connected with an output end of the frequency converter (2) to receive electric energy, and is correspondingly connected and drove the screw air compressor (4) to perform the reciprocating motion of air intake, compression, and exhaust to achieve an inflation action.

Figure 3:
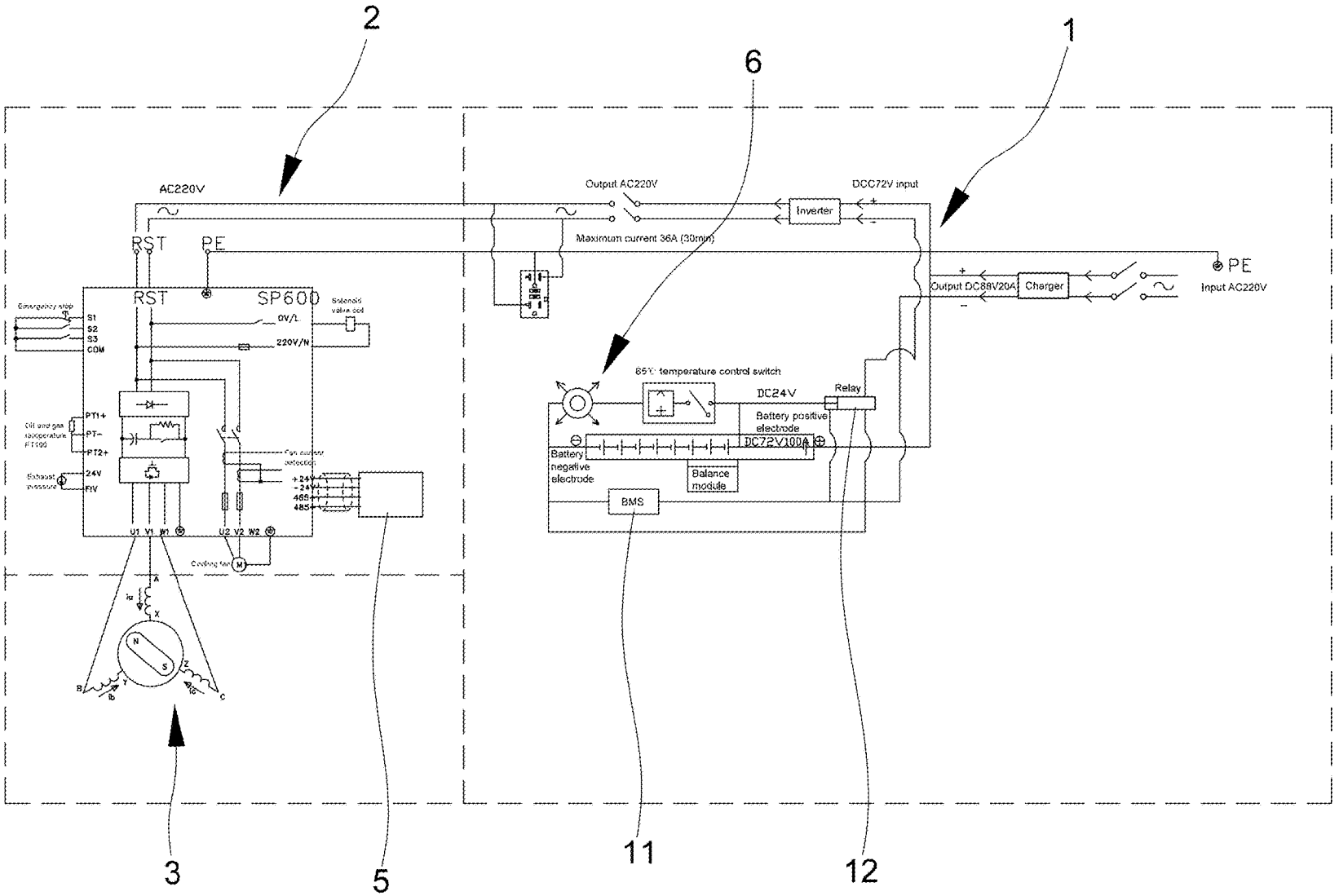
FIG. 3 is a circuit view of the screw air compressor unit with energy storage according to the present invention.

The present invention is composed of the power battery module (1), frequency converter (2), permanent magnet synchronous motor (3), and screw air compressor (4). Refer to FIGS. 1~3 as shown in each component, which is responsible for different processes and movements. The following is a detailed explanation:

(I) The power battery module (1) mainly supplies power to the screw air compressor (4), and in the power supply process, it is necessary to consider the safety, reliability and service life of the battery cell or battery pack use, so it needs to be controlled and managed, and the control logic principle of the power battery module (1) relates to the monitoring, balancing, protecting and other aspects of the battery.

Firstly, in terms of monitoring, the control logic of the power battery module (1) needs to monitor the voltage, current, temperature and other parameters of the battery cell or battery pack. The power battery module (1) includes a battery management system (11) [BMS] installed therein, through which the working status information of the battery is obtained. The battery management system [BMS] periodically measures the voltage, current, and temperature of the battery and transmits the data to the controller (12). The controller (12) can instantly understand the status of the battery based on the data, including charging status, discharging status, overcharge status, over-discharge status, temperature status, etc. At the same time, the controller (12) also needs to monitor problems such as battery capacity leakage and internal resistance increase, and can detect and alarm in time.

Secondly, in terms of balancing, the control logic of the power battery module (1) requires balancing control of the battery. Since there are different battery cells or battery packs inside the power battery module (1), the performance of different battery cells may be different, and the problem of battery imbalance may easily occur. In order to solve this problem, the controller (12) will control the balancing current between the battery cells through the BMS, and extract or inject charge from the battery cells to maintain the charge balance state between the battery cells. Balance control can effectively extend the service life of the battery pack and improve the energy utilization of the battery pack.

Finally, in terms of protecting, the control logic of the power battery module (1) needs to protect and control the battery. During the operation of the power battery module (1), dangerous situations such as overcharge, over-discharge, short circuit, and high temperature may occur, which may cause damage or even explosion of the power battery module (1). In order to prevent these dangerous situations from occurring, the controller (12) will perform protection control on the battery through the BMS. When the voltage, current, temperature and other parameters of the battery in the power battery module (1) exceed the safe range, the BMS will immediately notify the controller (12), and the controller (12) will take corresponding measures, such as disconnecting the charging circuit, disconnecting the discharging circuit, reducing the charging speed, reducing the discharging speed, etc. to ensure the safety of the battery. In summary, the control logic principle of the power battery module (1) is to manage the monitoring, balancing and protecting of the battery through the BMS. By monitoring the working status of the battery in real time, maintaining the charge balance between battery cells, and promptly detecting and handling battery abnormalities, the service life of the battery can be improved and the safety and reliability of the battery can be ensured.

In addition, the power source of the power battery module (1) can be obtained through general household charging and energy storage methods.

(II) Next, referring to FIG. 3, the frequency converter (2) mainly converts the electrical energy released by the power battery module (1) into three-phase electricity and variable frequency required by the permanent magnet synchronous motor (3). Its working principle is to apply frequency conversion technology and microelectronics technology to control the power control equipment of the permanent magnet synchronous motor (3) by changing the frequency of the motor's operating power supply. Furthermore, the frequency converter (2) uses the switching of the insulated gate bipolar transistor [IGBT] internally constructed thereof to adjust the voltage and frequency of the output power supply, and provides the required power supply voltage according to the actual needs of the permanent magnet synchronous motor (3), thereby achieving the purpose of energy saving and speed regulation. In addition, the frequency converter (2) is further equipped with a variety of protection functions, such as overcurrent, overvoltage, overload protection, etc.

The frequency converter (2) includes a rectifier, a filter, an inverter, a braking unit, a driving unit, a detection unit and a microprocessor unit respectively provided thereon.

Rectifier—a converter that uses a lot of diodes, which converts AC power into DC power, it is also possible to form a reversible converter with two sets of transistor converters, which can be regenerated due to the reversible power direction.

Filter [Flat-wave circuit]—The DC voltage rectified by the rectifier contains a pulsating voltage six times the frequency of the power supply. In addition, the pulsating current generated by the inverter also causes the DC voltage to fluctuate. In order to suppress voltage fluctuations, inductors and capacitors are used to absorb pulsating voltage (current). When the device capacity is small, if the power supply and main circuit components have margin, the inductors can be omitted, and a simple filter can be used.

Inverter—opposite to the rectifier, the inverter converts DC power into AC power at the required frequency. By turning on and off six switching devices at a determined time, a three-phase AC output can be obtained.

Control circuit—is a circuit that provides control signals to the main circuit that supplies power to the permanent magnet synchronous motor (3) (voltage and frequency are adjustable). It has a "computation circuit" for frequency and voltage, a "voltage and current detection circuit" for the main circuit, a "speed detection circuit" for the motor, a "drive circuit" that amplifies the control signal of the calculation circuit, and a "protection circuit" for the inverter and motor.

(III) The permanent magnet synchronous motor (3) is mainly a component that drives the screw air compressor (4) to operate. The permanent magnet synchronous motor (3) obtains electric energy from the output end of the frequency converter (2). The permanent magnet synchronous motor (3) is mainly composed of a rotor, an end cover, a stator and other components. Its working principle is that the starting and running of the permanent magnet synchronous motor (3) is formed by the interaction of the magnetic fields generated by the stator winding, the rotor squirrel cage winding and the permanent magnet.

When the permanent magnet synchronous motor (3) is stationary, a three-phase symmetrical current is passed through the stator winding to generate a stator rotating magnetic field. The stator rotating magnetic field generates current in the cage winding relative to the rotation of the rotor, forming a rotor rotating magnetic field. The non-synchronous torque generated by the interaction between the stator rotating magnetic field and the rotor rotating magnetic field causes the rotor to accelerate from standstill. In this process, the rotor permanent magnetic field and the stator rotating magnetic field rotate at different speeds, which will produce alternating torque. When the rotor accelerates to a speed close to the synchronous speed, the speeds of the rotor permanent magnetic field and the stator rotating magnetic field are nearly equal. The speed of the stator rotating magnetic field is slightly larger than the rotor permanent magnetic field, and their interaction produces torque that pulls the rotor into a synchronous operating state. In synchronous operation, the rotor winding no longer generates current. At this time, only the permanent magnet produces a magnetic field on the rotor, which interacts with the stator rotating magnetic field, generating a driving torque. It can be seen that the permanent magnet synchronous motor (3) is started by the non-synchronous torque of the rotor winding. After the start is completed, the rotor winding no longer works, and the magnetic field generated by the permanent magnet and the stator winding interacts to generate the driving torque.

(IV) The screw air compressor (4) is a terminal load and is directly connected to the rotor of the permanent magnet synchronous motor (3). The screw air compressor (4) is a volumetric gas compression machine whose working volume undergoes rotary motion. The compression of gas is realized by the change of volume, and the change of volume is achieved by the rotation movement of a pair of rotors of the screw air compressor (4) in the casing.

The screw air compressor (4) mainly has a pair of mutually meshing spiral rotors arranged in parallel in the body. The rotor with convex teeth outside the pitch circle is usually called a male rotor or a male screw. The rotor with concave teeth inside the pitch circle is called a female rotor or female screw. Generally, the male rotor is connected to the prime mover, and the male rotor drives the female rotor to rotate the last pair of bearings on the rotor to achieve axial positioning and bear the axial force in the air compressor. The cylindrical roller bearings at both ends of the rotor enable the rotor to achieve radial positioning and bear the radial force in the air compressor. The air compressor has two hole openings of a certain shape and size, which are respectively arranged at both ends of the body thereof. One hole opening is for suction and is called the air inlet; the other hole opening is for exhaust and is called the exhaust port. Its working principle is divided into three parts: air intake, compression and exhaust.

The air intake process of the screw air compressor (4)—when the rotors rotate, the space of the teeth grooves of the male and female rotors is the largest when they rotate to the opening of the air inlet end wall. At this time, the space of the teeth grooves of the rotors is communicated with the air inlet, the gas in the teeth grooves is completely exhausted during exhaust. When the exhaust is completed, the teeth grooves are in a vacuum state. When the rotors rotate to the air inlet, the outside air is sucked in and enters the teeth grooves of the male and female rotors along the axial direction. When the gas fills the entire teeth grooves, the air inlet side end surface of the rotor rotates away from the air inlet of the casing, and the gas in the teeth grooves is sealed.

The compression process of the screw air compressor (4)—when the male and female rotors finish inhaling, the teeth tips of the male and female rotors will be closed with the casing, and the gas will no longer flow out in the teeth grooves. The meshing surfaces are gradually moved toward the exhaust end. The gap in the space of the teeth grooves between the meshing surface and the exhaust port gradually decreases, and the gas in the teeth groove is compressed to increase the pressure.

Exhaust process of the screw air compressor (4)—when the meshing end surface of the rotor rotates to communicate with the exhaust port of the casing, the compressed gas begins to be discharged until the meshing surface between the teeth tips and the teeth grooves move to the exhaust end surface. At this time, the space of the teeth grooves between the meshing surface of the male and female rotors and the exhaust port of the casing is 0, that is, the exhaust process is completed. At the same time, the length of the teeth groove between the meshing surface of the rotor and the air inlet of the casing reaches the longest, and the air intake process resumes. In this way, through repeated air intake, compression, and exhaust actions, the screw air compressor (4) compresses the air to the gas storage bottle (41) [as shown in FIGS. 1 and 2], and the user can use it according to the needs.

In summary, the present invention changes the source of power supply and uses the power battery module (1) to supply power to the permanent magnet synchronous motor (3) and to store energy in the linked screw air compressor (4), effectively achieving energy saving, noise reduction, and compact equipment size advantages and benefits. In addition, a control panel (5) is provided on the unit for the user to operate. The control panel (5) is electrically connected to the power battery module (1), the frequency converter (2), the permanent magnet synchronous motor (3), and the screw air compressor (4), allowing the user to control the air compressor unit through the control panel (5). At the same time, a cooling fan (6) is further arranged on the unit. The cooling fan (6) corresponds to the power battery module (1) and can dissipate the heat energy generated by the power battery module (1) and effectively cool down.

The present invention has the following advantages:

1. By changing the source of power supplied, the present invention uses a power battery module to supply power to the permanent magnet synchronous motor and to store energy in the linked air compressor, thus effectively achieving the effects and advantages of energy saving, low power, low noise, and reduced equipment size.
2. The control logic principle of the power battery module of the present invention is to manage the monitoring, balancing and protection of the battery through the BMS, through real-time monitoring of the working state of the battery, to maintain the charge balance between the battery cells, and to discover and deal with the abnormal situation of the battery in time, the service life of the battery can be improved, and the safety and reliability of the battery can be ensured.
3. The present invention uses the insulated gate bipolar transistor [IGBT] inside the frequency converter to adjust the voltage and frequency of the output power supply and can provide the required power supply voltage according to the actual needs of the permanent magnet synchronous motor, thereby achieving the purpose of energy saving and speed regulation.
4. The air compressor unit of the present invention is small in size, easy to carry and move, and can be moved and used by users according to changing factors such as needs and construction sites, achieving practical and convenient effects.

In summary, it can be seen that the present invention has indeed achieved the desired improvement effect by breaking through the previous technical structure, and it is not easily imagined by those familiar with the art. Furthermore, this invention has not been disclosed before the application, and its non-obviousness and industrial applicability obviously meet the application requirements for a creation patent. Therefore, a patent application is filed in accordance with the law, and the approval of the creative patent application is requested to encourage creation, which is sincerely appreciated.

What is claimed is:

1. A screw air compressor unit with energy storage, comprising a power battery module, a frequency converter, a permanent magnet synchronous motor and a screw air compressor respectively provided thereon, wherein the screw air compressor comprises a pair of mutually meshing spiral rotors consisting of a male rotor and a female rotor arranged in a casing, the power battery module is composed of one or more battery cells or battery packs, mainly responsible for storing and releasing electrical energy, wherein the power battery module is correspondingly connected with the screw air compressor, and provides a power source therefor, wherein one end of the frequency converter is connected with the power battery module, and the other end is connected with the permanent magnet synchronous motor, wherein the frequency converter converts the electrical energy output by the power battery module into the voltage and frequency required by the permanent magnet synchronous motor, so as to start the permanent magnet synchronous motor to connect and drive the screw air compressor to carry out the repeated movement of air intake, compression and exhaust to achieve an inflation action.

2. The screw air compressor unit with energy storage, as recited in claim 1, wherein the power battery module comprises a battery management system [BMS] installed therein, which is capable of obtaining the working status information of the power battery module, wherein the battery management system periodically measures the voltage, current, and temperature of the power battery module.

3. The screw air compressor unit with energy storage, as recited in claim 2, further comprises a controller provided on the screw air compressor unit, wherein a data obtained by the battery management system [BMS] is transmitted to the controller, wherein the controller protects the power battery module through the battery management system.

4. The screw air compressor unit with energy storage, as recited in claim 3, wherein the frequency converter converts the electrical energy released by the power battery module into the three-phase electricity and variable frequency required by the permanent magnet synchronous motor.

5. The screw air compressor unit with energy storage, as recited in claim 2, wherein the frequency converter converts the electrical energy released by the power battery module into the three-phase electricity and variable frequency required by the permanent magnet synchronous motor.

6. The screw air compressor unit with energy storage, as recited in claim 1, wherein the frequency converter converts the electrical energy released by the power battery module into the three-phase electricity and variable frequency required by the permanent magnet synchronous motor.

7. The screw air compressor unit with energy storage, as recited in claim 1, wherein the frequency converter has an insulated gate bipolar transistor [IGBT] arranged therein, wherein the switching of the insulated gate bipolar transistor is capable of adjusting the voltage and frequency of the output power supply of the power battery module, and provide the required power supply voltage according to the needs of the permanent magnet synchronous motor.

8. The screw air compressor unit with energy storage, as recited in claim 1, wherein the frequency converter includes a rectifier, a filter, an inverter, a braking unit, a driving unit, a detection unit and a microprocessor unit respectively provided thereon.

9. The screw air compressor unit with energy storage, as recited in claim 1, further comprises a cooling fan provided on the screw air compressor unit, wherein the cooling fan corresponds to the power battery module and is capable of dissipating the heat energy generated by the power battery module.

10. The screw air compressor unit with energy storage, as recited in claim 1, further comprises a control panel provided on the screw air compressor unit, wherein the control panel is electrically connected with the power battery module, the frequency converter, the permanent magnet synchronous motor and the screw air compressor for user operation.

* * * * *